US006994449B2

(12) United States Patent
Kim

(10) Patent No.: US 6,994,449 B2
(45) Date of Patent: Feb. 7, 2006

(54) FLASHLIGHT WITH SECUREMENT CAPABILITY

(75) Inventor: Paul Y. Kim, Irvine, CA (US)

(73) Assignee: Surefire, LLC, Fountain Valley, CA (US)

( * ) Notice: Subject to any disclaimer, the term of this patent is extended or adjusted under 35 U.S.C. 154(b) by 97 days.

(21) Appl. No.: 10/133,894

(22) Filed: Apr. 26, 2002

(65) Prior Publication Data

US 2003/0202345 A1 Oct. 30, 2003

(51) Int. Cl.
*F21L 7/00* (2006.01)

(52) U.S. Cl. ..... 362/190; 362/191; 362/202; 362/396; 362/184; 362/110

(58) Field of Classification Search ..... 362/190, 362/191, 202, 396, 206, 110, 208, 184, 394; 200/168; 361/184, 206, 394
See application file for complete search history.

(56) References Cited

U.S. PATENT DOCUMENTS

| | | | | |
|---|---|---|---|---|
| 1,279,186 | A | 9/1918 | Wahl | |
| 2,134,856 | A | 11/1938 | Burgess | |
| 2,385,640 | A | 9/1945 | Packer et al. | |
| 2,470,421 | A | 5/1949 | Woody | |
| 3,184,593 | A * | 5/1965 | Wiegelmann et al. | 362/396 |
| 3,711,703 | A | 1/1973 | Bacevius | |
| 3,790,734 | A * | 2/1974 | Raab et al. | 200/302.2 |
| 4,345,304 | A * | 8/1982 | Penney et al. | 362/183 |
| 4,484,253 | A | 11/1984 | Roberts | |
| 5,025,966 | A | 6/1991 | Potter | |
| 5,144,546 | A * | 9/1992 | Burdi | 362/191 |
| 5,211,471 | A * | 5/1993 | Rohrs | 362/206 |
| 5,570,965 | A | 11/1996 | Coolen | |
| 5,590,484 | A | 1/1997 | Mooney et al. | |
| 5,630,535 | A | 5/1997 | Valenti | |
| 5,642,932 | A | 7/1997 | Matthews | |
| 5,660,363 | A * | 8/1997 | Maglica | 248/288.31 |
| 5,816,684 | A * | 10/1998 | Yu | 362/191 |
| 5,826,363 | A | 10/1998 | Olson | |
| 5,871,272 | A * | 2/1999 | Sharrah et al. | 362/184 |
| 6,012,824 | A | 1/2000 | Sharrah et al. | |
| 6,183,106 | B1 * | 2/2001 | Thummel et al. | 362/188 |
| 6,250,771 | B1 | 6/2001 | Sharrah et al. | |
| 6,609,810 | B2 * | 8/2003 | Kim | 362/110 |

OTHER PUBLICATIONS

U.S. Appl. No. 09/606,605, filed Jun. 29, 2000, Matthews.
U.S. Appl. No. 10/159,359, filed May 29, 2002, Matthews.
United States Department of Defense, Military Standard: Dimensioning of Accessory Mounting Rail for Small Arms Weapons, Feb. 3, 1995.

* cited by examiner

*Primary Examiner*—Sandra O'Shea
*Assistant Examiner*—Anabel Ton
(74) *Attorney, Agent, or Firm*—David Weiss

(57) ABSTRACT

Apparatus and methods directed to a hand holdable flashlight having a grooved rear cap for being secured to an object, through utilization of an interface device securable to the rear cap and to the object. The grooved rear cap also implements securement of a removable guard for protecting a rear end switch actuator from being accidentally actuated in situations when the flashlight is not secured to the interface device.

27 Claims, 2 Drawing Sheets

FLASHLIGHT WITH SECUREMENT CAPABILITY

BACKGROUND OF THE INVENTION

This invention relates to flashlights, and more particularly to a flashlight that is adapted for being secured to various objects and for having a switch guard removably secured thereto.

It is often useful to secure a flashlight to an object, such as to an accessory mount secured to a firearm. Usually such flashlights are equipped with an integral securement device specifically for securement to a particular type of object, for example to an accessory mount secured to a firearm. Such lights with integral securement devices are generally useful only with a particular mount, or with another type of object to which the flashlight is specifically securable, and are not readily or conveniently useful as a hand held flashlight.

SUMMARY OF THE INVENTION

Against this background, the present invention provides apparatus and methods directed to a hand holdable flashlight having a grooved rear cap for being secured to an object, through utilization of an interface device securable to the rear cap and to the object. The grooved rear cap also implements securement of a removable guard for protecting a rear end switch actuator from being accidentally actuated in situations when the flashlight is not secured to the interface device.

According to one aspect of the present invention, there is provided a flashlight securable to an object, comprising in combination: a flashlight including a battery housing and a rear cap secured to the housing, the rear cap having a longitudinal axis; a groove in the rear cap perpendicular to the longitudinal axis; and an interface device including a first portion adapted to be removably received by the groove for holding the flashlight and a second portion adapted to be secured to the object. The first portion of the interface device preferably includes an arcuate member fitted into the groove, and the groove is preferably an annular groove. Another member (also preferably arcuate) may be fitted into the groove for securing the first-mentioned arcuate member to the rear cap.

According to another aspect of the flashlight of the present invention, there is provided a substantially cylindrical elastomeric cover or switch guard having a radially inward ledge at one end removably receivable by the groove for securing the cover to the rear cap, the cover longitudinally extending laterally of a push button switch actuator projecting from the rear cap.

The present invention further provides a method for securing a flashlight to an object, comprising: providing a flashlight including a rear cap having a longitudinal axis; providing a groove (preferably an annular groove) in the rear cap perpendicular to the longitudinal axis; providing an interface device having a first portion for being removably received by the groove for holding the flashlight and a second portion for being removably secured to the object; securing the interface device to the object; and placing the flashlight to the interface device with the first portion received by the groove. A securing member is preferably provided, and the securing member (also preferably arcuate) is fitted into the groove and secured to the first portion of the interface device.

In another aspect of the present invention, a method is provided for preventing accidental switching of the flashlight, comprising: providing a flashlight including a rear cap and a push button switch actuator rearwardly extending from the rear cap; providing a groove in the rear cap perpendicular to the longitudinal axis; providing a substantially cylindrical elastomeric switch guard having a radially inward ledge at one end for being fitted into the groove; and installing the elastomeric switch guard on the rear cap with the ledge fitted into the groove.

According to a further aspect of the present invention, a method is provided for securing a flashlight to an object and for preventing accidental switching of the flashlight, comprising: providing a flashlight including a rear cap having a longitudinal axis and a push button switch actuator rearwardly extending from the rear cap; providing a groove in the rear cap perpendicular to the longitudinal axis; providing a substantially cylindrical elastomeric switch guard having a radially inward ledge at one end for being fitted into the groove; providing an interface device having a first portion for being removably received by the groove for holding the flashlight and a second portion for being removably secured to the object; and, in the alternative, securing the interface device to the object and placing the flashlight to the interface device with the first portion received by the groove, or installing the elastomeric switch guard on the rear cap with the ledge fitted into the groove. This aspect of the method preferably includes, in the flashlight placing step, fitting a securing member into the groove and securing the securing member to the first portion of the interface device.

BRIEF DESCRIPTION OF THE DRAWINGS

The novel features believed to be characteristic of the invention, together with further advantages thereof, will be better understood from the following description considered in connection with the accompanying drawings in which preferred embodiments of the present invention are illustrated by way of example. It is to be expressly understood, however, that the drawings are for the purpose of illustration and description only and are not intended as a definition of the limits of the invention.

DETAILED DESCRIPTION OF THE PREFERRED EMBODIMENTS

Figure 1:
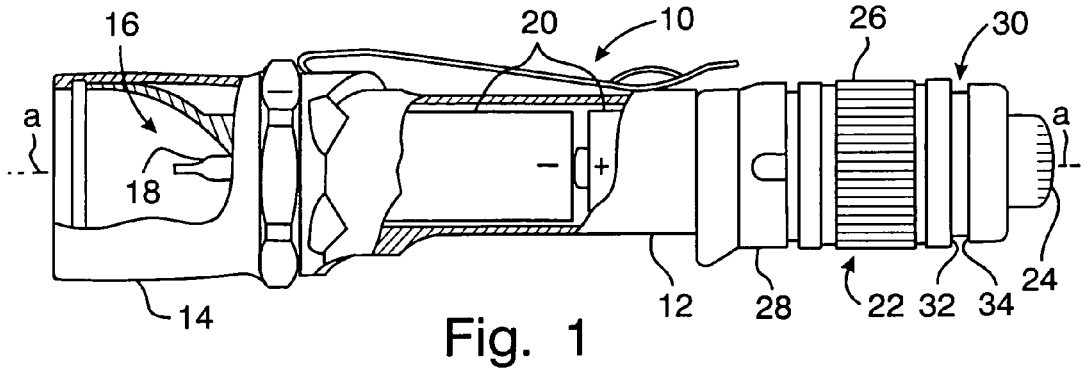
FIG. 1 is a side view of a flashlight, partly broken away, having a rear cap according to a preferred embodiment of the present invention.

Turning to FIG. 1, there is shown an example of a flashlight 10 which may be conveniently held in the hand of a user, the flashlight 10 including a generally cylindrical battery housing 12, a head 14 at the flashlight's front end including a lamp assembly 16 with a lamp 18 in electrical circuit with batteries 20 in the battery housing 12, and a rear cap assembly 22 including a rearwardly projecting push button diaphragm 24 for actuating the batteries 20 to energize the lamp 18. Such flashlights may be of the type shown, for example, in U.S. Pat. No. 5,642,932 to John W. Matthews, assigned to the assignee of the present invention, the disclosure of which Matthews patent is incorporated herein by reference.

The improvement of the present invention, in its preferred embodiment, is concerned with the flashlight rear cap assembly 22 which includes a rear cap 26 (see also FIG. 7) secured at the rear of the battery housing 12, the rear cap 26 being rotatable about the flashlight's longitudinal axis a, such rotation being with respect to the battery housing 12. Such rotational securement of the rear cap 26 may be implemented by threadably engaging a cap retainer element 28 that in turn is fixedly secured to the rear end portion of the battery housing 12, and the rear cap 26 is rotatably removable from the cap retainer 28.

The outer surface of the rear cap 26 includes a groove 30 perpendicular to the cap's longitudinal axis a, the groove 30 including two facing side walls 32, 34. In the preferred embodiment, the groove 30 is an annular groove, about the cylindrical periphery of the rear cap 26.

Figure 2:
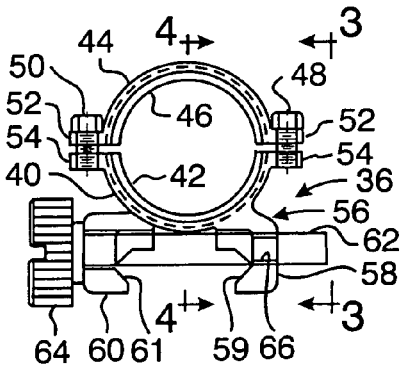
FIG. 2 is a preferred embodiment of an interface device or holder for implementing securement of the flashlight of FIG. 1 to an object.
Figure 4:
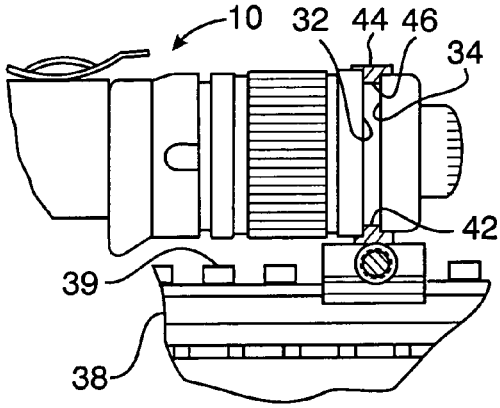
FIG. 4 is similar to FIG. 3, however with the installed interface device of FIG. 2 shown partially in cross-section taken along the line 4—4 of FIG. 2 in the direction of the appended arrows, the interface device also shown secured to an object.
Figure 3:
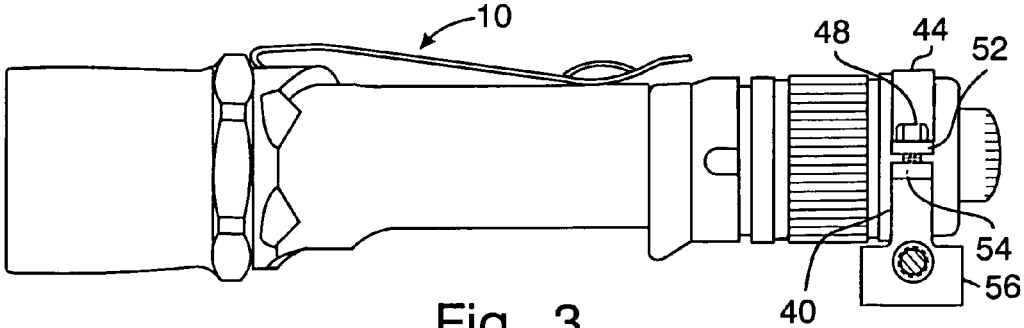
FIG. 3 is a side view of the flashlight of FIG. 1 with the interface device of FIG. 2 installed thereon, the interface device being viewed along the line 3—3 of FIG. 2 in the direction of the appended arrows.

Considering FIGS. 2–4, an interface device 36 is provided for releasably securing the flashlight 10 to an object 38. The interface device 36 includes a first portion 40 for holding the flashlight, the portion 40 shown in FIG. 2 as an arcuate member 40 having a radially inward tongue 42 fitting snuggly into the groove 30 between and preferably engaging the groove's facing walls 32 and 34 (see FIG. 4). The preferred embodiment of the interface device 36 further includes a flashlight securement member 44 such as another arcuate member 44 having a radially inward tongue 46 for fitting snuggly into the groove 30 preferably engaging the groove's facing walls 32 and 34. The flashlight holding member 40 and the flashlight securement member 44 are removably secured to each other, such as by bolts 48, 50 through apertured lateral flanges 52 of one of the arcuate members (say arcuate member 44) and threadedly secured to threaded apertured laterally extending flanges 54 of the other arcuate member 40.

The interface device 36 includes a second portion 56 for being secured to the object 38. In the preferred interface device 36 shown in FIG. 2, the second or object securement portion 56 may include a Weaver style or other clamping device for mounting to a rail structure shown as the object 38 in FIG. 4. Such a rail mount structure may be of a type well known in the firearms art for mounting accessories such as weapon lights to a firearm. Examples of such rails for accessory mounts are provided by rail interface system devices such as manufactured by Knights Manufacturing Company (of Vero Beach, Fla.), including those disclosed in U.S. Pat. No. 5,826,363 of Douglas D. Olsen, as well as those disclosed in U.S. Pat. No. 5,590,484 of Aurelius A. Mooney et al., both of which patents are incorporated herein by reference. One such prior art rail comprises a series of longitudinally spaced-apart ribs 39 as specified in MIL-STD-1913, commonly known as a Picatinny rail and shown in FIG. 4 as a top rail comprising the spaced-apart ribs 39.

In FIG. 2, the clamp 56 includes a first leg 58 fixedly secured to the flashlight holding member 40, and a laterally moveable second leg 60. A screw 62 having a knurled knob at one end extends through a bore in the second leg 60 and threadedly engages a threaded bore 64 in the first leg 58. It may be appreciated that, when the interface device 36 is placed to the rail structure 38 with opposing legs 58 and 60 straddling the Picatinny rail defined by the ribs 39, manual rotation of the knurled knob 64 causes the rail engaging surfaces 61 and 59 to clampingly engage the Picatinny rail and to secure the interface device 36 thereto. Loosening rotation of the knurled knob 64 permits the interface device 36 to be removed from the rail structure 38.

In a preferred method of use, the interface device 36 may be secured to the rail structure 38 as described above. The flashlight 10 may then be placed in combination with the interface device 36 such that the tongue 42 of the flashlight holding arcuate member 40 is inserted in the annular groove 30 in the flashlight's rear cap 26. The flashlight securement arcuate member 44 is then installed such that its tongue 46 is inserted in the groove 30, opposite or above the member 40 as viewed in the drawing of FIGS. 2–4, and the member 44 is tightened toward the flashlight holding member 40 by rotational adjustment of the bolts 48, 50. In such manner, the flashlight 10 is removably secured by the interface device 36 to the object or rail structure 38.

Of course, the flashlight may be secured to the interface device 36 before securing the interface device 36 to the object or rail structure 38. In either event, the flashlight 10 may be removed from the interface device 36 while the interface device is secured to the object or rail structure 38, and the interface device 36 may be removed from the object or rail structure 38. Alternatively, the interface device 36 with the flashlight 10 secured thereto may be removed from the object or rail structure 38, and the flashlight 10 may then be removed from the interface device 36.

Figure 5:
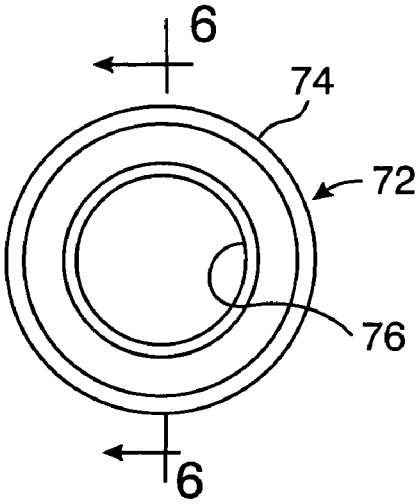
FIG. 5 is a rear view of a preferred embodiment of a switch guard which may be removably secured to the flashlight end cap according to the present invention.

A feature of the flashlight 10 of the present invention is its ability to utilize the rear cap groove 30 for securing a cover or shroud for protecting a rear end switch device. As shown in FIG. 7, the flashlight's rear cap 26 may house a switch 68 including a push button switch actuator 70 rearwardly projecting from the rear cap 26 and covered by an elastomeric diaphragm 24. The switch 68 may be of an ON/OFF type, whereby one depression of the diaphragmed push button 70 completes a circuit causing the batteries 20 to energize the lamp 18 and a successive depression of the diaphragmed push button actuator 70 opens the circuit such that the lamp 18 is not energized by the batteries 20. In order to protect against accidental ON actuation of the push button actuator 70, such as by the flashlight's rear end being bumped when the flashlight is hand held or is stored or is in transit, the present invention provides for a releasably securable switch guard a preferred embodiment of which is shown in FIGS. 5–7.

Figure 6:
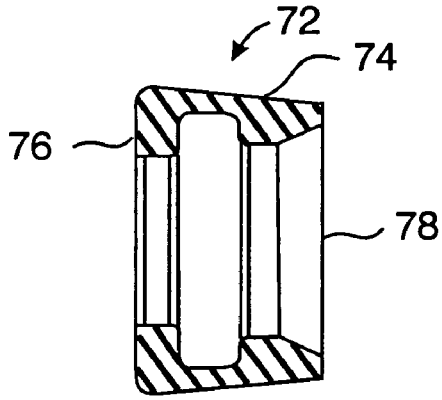
FIG. 6 is a cross-sectional view of the switch guard of FIG. 5, taken along the line 6—6 of FIG. 5 in the direction of the appended arrows.
Figure 7:
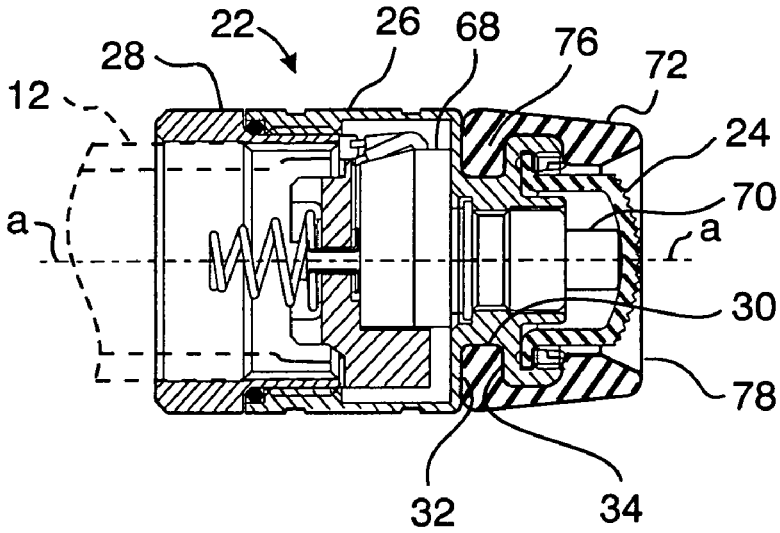
FIG. 7 is a longitudinal cross-sectional view of a preferred embodiment of a flashlight rear cap assembly according to the present invention showing the switch guard of FIGS. 5 and 6 removably secured thereto.

The preferred embodiment of the switch cover or guard 72, which is constructed of an elastomeric material such as rubber, comprises a generally or substantially cylindrical tube which, in the preferred embodiment, the outer surface 74 may be rearwardly tapered as shown in FIG. 6. The forward end of the switch guard 72 is provided with a radially inward ledge 76 of a radial length and longitudinal thickness for fitting snugly into the annular groove 30 and preferably engaging the groove's facing walls 32 and 34 as shown in FIG. 7. The elastomeric nature of the switch guard 72 permits the switch guard 72 to be "worked onto" the flashlight's rear cap 26 until the ledge 76 is inserted into the groove 30. When so installed, the switch guard's length (i.e. the dimension along the longitudinal axis a) is such that the guard 72 longitudinally extends laterally of the entirety of the rearwardly projecting push button actuator 70 and diaphragm 24. It may be appreciated that the installed switch guard 72 provides protection against accidental depression of the switch actuator 70 under many conditions, while the rear opening 78 of the switch guard 72 permits intentional switch actuation by a user. It may be further appreciated that the elastomeric nature of the switch guard 72 permits the switch guard 72 to be manually removed from the flashlight's rear cap 26.

The rear cap 26, in its preferred embodiment with a single dual-purpose groove 30, permits a user the option either of removably securing the flashlight 10 to an object 38 through the interface device 36, or of securing the switch guard 72 to the rear cap 26. It may be appreciated that the flashlight rear cap 26 may be provided with two longitudinally spaced-apart grooves 30 for permitting both options simultaneously if desired.

Interface devices may be used for securement to objects other than a Picatinny rail or other rail mount; for example, the object securement portion of the interface device may be adapted for securement to a bicycle handle or frame, or to binoculars, or to a helmet.

Thus, there have been described preferred embodiments of apparatus and methods directed to a hand holdable flashlight having a grooved rear cap for being secured to an object, through utilization of an interface device securable to the rear cap and the object, the grooved rear cap also implementing securement of a removable guard for protecting a rear end switch actuator from being accidentally actuated. Other embodiments of the present invention, and variations of the embodiments described herein, may be developed without departing from the essential characteristics thereof. Accordingly, the invention should be limited only by the scope of the claims listed below.

I claim:

1. Flashlight apparatus securable to an object, comprising in combination:

a flashlight including a battery housing and a rear cap secured to said housing, said rear cap having a longitudinal axis;

a groove in said rear cap perpendicular to said longitudinal axis; and an interface device including a first portion adapted to be removably received by said groove for holding said flashlight and a second portion adapted to be secured to the object.

2. The apparatus according to claim 1, wherein:

said first portion of said interface device includes an arcuate member for being fitted into said groove.

3. The apparatus according to claim 2, wherein:

said groove is an annular groove.

4. The apparatus according to claim 3, further including:

another member adapted to be fitted into said groove for securing said arcuate member to said rear cap when said arcuate member is fitted into said groove.

5. The apparatus according to claim 4, wherein:

said other member is arcuate.

6. The apparatus according to claim 5, wherein:

each of said arcuate member and said other member define a semi-circle.

7. The apparatus according to claim 1, including:

a front lamp assembly secured to said housing;

a push button rearwardly projecting from said rear cap for controlling energization of a lamp in said lamp assembly by batteries in said housing;

a substantially cylindrical elastomeric cover having a radially inward ledge at one end removably receivable by said groove, said cover longitudinally extending laterally of said push button when said ledge is received by said groove.

8. The apparatus according to claim 1, the object being a rail mount, wherein:

said second portion includes a clamp for the rail mount.

9. In a flashlight including a rear cap having a longitudinal axis, the flashlight including a switch having a push button switch actuator projecting from the rear cap, the improvement comprising:

a groove in said rear cap perpendicular to said longitudinal axis; and a substantially cylindrical elastomeric cover having a radially inward ledge at one end removably received by said groove, said cover longitudinally extending laterally of said push button switch actuator and having an opening exposing said push button switch actuator.

10. The flashlight according to claim 9, wherein:

said groove is an annular groove.

11. In a method of securing a flashlight to an object, the steps comprising:

providing a flashlight including a rear cap having a longitudinal axis;

providing a groove in said rear cap perpendicular to said longitudinal axis;

providing an interface device having a first portion for being removably received by said groove for holding said flashlight and a second portion for being removably secured to the object;

securing said interface device to the object; and placing said flashlight to said interface device with said first portion received by said groove.

12. The method according to claim 11, further including:

fitting a securing member into said groove; and securing said securing member to said first portion of said interface device.

13. The method according to claim 11, wherein:

said groove is an annular groove;

said first portion of said interface device includes an arcuate member for being fitted into said groove; and during said flashlight placing step, said flashlight is placed to said interface device with said arcuate member fitted in said groove.

14. The method according to claim 13, including:

fitting another arcuate member into said groove; and securing said other arcuate member to said arcuate member of said first portion.

15. The method according to claim 14, the object being a rail mount, wherein said second portion of said interface device includes a clamp for the rail mount, the method including:

clamping said clamp to the rail mount.

16. The method according to claim 11, wherein said flashlight includes a push button switch actuator rearwardly extending from said rear cap, the method including:

providing a substantially cylindrical elastomeric switch guard having a radially inward ledge at one end for being fitted into said groove;

removing said flashlight from said interface device; and installing said elastomeric switch guard on said rear cap with said ledge fitted into said groove.

17. In a method of preventing accidental switching of a flashlight, the steps comprising:

providing a flashlight including a rear cap and a push button switch actuator rearwardly extending from said rear cap;

providing a groove in said rear cap perpendicular to said longitudinal axis;

providing a substantially cylindrical elastomeric switch guard having a radially inward ledge at one end for being fitted into said groove and an opening in the other end; and installing said elastomeric switch guard on said rear cap with said ledge fitted into said groove, said elastomeric switch guard extending laterally of said push button switch actuator with said opening exposing said push button switch actuator.

18. In a method of preventing accidental switching of a flashlight, the steps comprising:

providing a flashlight including a rear cap and a push button switch actuator rearwardly extending from said rear cap;

providing a groove in said rear cap perpendicular to said longitudinal axis;

providing a substantially cylindrical elastomeric switch guard having a radially inward ledge at one end for being fitted into said groove;

installing said elastomeric switch guard on said rear cap with said ledge fitted into said groove;

providing an interface device having a first portion for being removably received by said groove for holding said flashlight and a second portion for being removably secured to an object;

removing said elastomeric switch guard from said rear cap; and placing said flashlight to said interface device with said first portion received by said groove.

19. The method according to claim 18, further including:

fitting a securing member into said groove; and securing said securing member to said first portion of said interface device.

20. The method according to claim 18, wherein:

said groove is an annular groove;

said first portion of said interface device includes an arcuate member for being fitted into said groove; and during said flashlight placing step, said flashlight is placed on said interface device with said arcuate member fitted in said groove.

21. The method according to claim 20, including:

fitting another arcuate member into said groove; and securing said other arcuate member to said arcuate member of said first portion.

22. The method according to claim 21, the object being a rail mount for a firearm, wherein said second portion of said interface device includes a clamp for the rail mount, the method including:

clamping said clamp to the rail mount.

23. A method for securing a flashlight to an object and for preventing accidental switching of the flashlight, comprising:

providing a flashlight including a rear cap having a longitudinal axis and a push button switch actuator rearwardly extending from said rear cap;

providing a groove in said rear cap perpendicular to said longitudinal axis;

providing a substantially cylindrical elastomeric switch guard having a radially inward ledge at one end for being fitted into said groove;

providing an interface device having a first portion for being removably received by said groove for holding said flashlight and a second portion for being removably secured to the object; and at the option of a user, securing said interface device to the object and placing said flashlight to said interface device with said first portion received by said groove, or installing said elastomeric switch guard on said rear cap with said ledge fitted into said groove.

24. The method according to claim 23, including:

during the flashlight placing step, fitting a securing member into said groove and securing said securing member to said first portion of said interface device.

25. The method according to claim 23, wherein:

said groove is an annular groove;

said first portion of said interface device includes an arcuate member for being fitted into said groove; and during the flashlight placing step, said flashlight is placed to said interface device with said arcuate member fitted in said groove.

26. The method according to claim 25, including:

fitting another arcuate member into said groove; and securing said other arcuate member to said arcuate member of said fist portion.

27. The method according to claim 26, the object being a rail mount for a firearm, wherein said second portion of said interface device includes a clamp for the rail mount, the method including:

clamping said clamp to the rail mount.

* * * * *